US007290765B2

(12) United States Patent
Carter et al.

(10) Patent No.: US 7,290,765 B2
(45) Date of Patent: Nov. 6, 2007

(54) EXIT ROLL FOR AN IMAGE FORMING DEVICE

(75) Inventors: Daniel L. Carter, Georgetown, KY (US); Larry Steven Foster, Lexington, KY (US); Brian Allen Blair, Richmond, KY (US); David Erwin Rennick, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 162 days.

(21) Appl. No.: 11/231,407

(22) Filed: Sep. 21, 2005

(65) Prior Publication Data

US 2007/0064076 A1 Mar. 22, 2007

(51) Int. Cl.
*B65H 29/20* (2006.01)

(52) U.S. Cl. ..... 271/314

(58) Field of Classification Search ..... 271/314; 492/30, 33, 34

See application file for complete search history.

(56) References Cited

U.S. PATENT DOCUMENTS

| | | | | |
|---|---|---|---|---|
| 3,981,496 | A * | 9/1976 | Jensen et al. | 271/314 |
| 4,553,828 | A | 11/1985 | Burger et al. | |
| 4,729,557 | A | 3/1988 | Kiyohara | |
| 4,933,726 | A | 6/1990 | Moriyama | |
| 4,988,087 | A | 1/1991 | Sardano et al. | |
| 5,012,295 | A | 4/1991 | Ikkatai et al. | |
| 5,104,282 | A | 4/1992 | Gleason | |
| 5,201,517 | A | 4/1993 | Stemmle | |
| 5,700,005 | A | 12/1997 | Chen | |
| 6,135,591 | A | 10/2000 | Ikeda et al. | |
| 6,250,626 | B1 | 6/2001 | Tanaka | |
| 6,394,442 | B1 | 5/2002 | Antinora et al. | |
| 6,488,279 | B1 * | 12/2002 | Fukuda et al. | 271/314 |
| 6,581,930 | B2 | 6/2003 | Kim | |
| 6,769,686 | B1 | 8/2004 | Yuge | |
| 2006/0157922 | A1 * | 7/2006 | Carter et al. | 271/264 |
| 2006/0170151 | A1 * | 8/2006 | Oshida | 271/314 |

FOREIGN PATENT DOCUMENTS

| | | | |
|---|---|---|---|
| JP | 63008157 A | * | 7/1988 |
| JP | 05294530 A | * | 11/1993 |
| JP | 06032509 A | * | 2/1994 |
| JP | 06064814 A | * | 3/1994 |

* cited by examiner

*Primary Examiner*—David H Bollinger
(74) *Attorney, Agent, or Firm*—Coats & Bennett, PLLC

(57) ABSTRACT

An exit roll for use in an image forming device. The exit roll may include a body and a kicker section each configured to mount to a shaft. The kicker section may include a plurality of fingers spaced around the periphery. Each of the fingers may include a first section that is substantially parallel to the shaft, and a second section that extends outward way from the shaft. The fingers may be flexible in an upwards and downwards direction into and away from the shaft. The exit roll is constructed to move media sheets out of the exit port and away from the image forming device.

20 Claims, 7 Drawing Sheets

EXIT ROLL FOR AN IMAGE FORMING DEVICE

BACKGROUND

Image forming devices form an image on a media sheet as the sheets move through a transfer area. The media sheet with image is then moved from the transfer area and exited from the device through an exit port and into an output area. The exit port should be constructed in a manner to ensure the sheet moves out of the interior of the device and away from the exit port.

Media jams may result if the exit port is not constructed properly. The media sheet may move along the media path but the trailing edge of the sheet does not clear the exit port. This may occur because the media sheet contacts an output tray within the output area that prevents the trailing edge of the sheet from clearing through the exit port. The trailing edge of the sheet may also become snagged within the exit port thus preventing the sheet from exiting into the output area.

One problem the snagged sheet causes is with collation. A subsequent sheet may feed out of the device before the snagged sheet resulting in an improper order of printed sheets output from the device. The snagged sheet may also cause a media jam. The snagged media sheet may block the exit port and prevent the subsequent media sheet from moving through the exit port. The media jam requires stopping the device, accessing and removing the jammed sheet(s), and restarting the printing process. Media jams greatly reduce the overall throughput of the device, and are frustrating to the user.

A mechanism to move the media sheets from the exit port and into the output area should not negatively affect the cost of the device. Many purchasers make buying decisions based on the device cost. Mechanisms that greatly add to the cost may result in a better product, but may cause the purchaser to select a competitor's product.

SUMMARY

The present application is directed to an exit roll for use in an image forming device. The exit roll may include a body and a kicker section each configured to mount to a shaft. The kicker section may include a plurality of fingers spaced around the periphery. Each of the fingers may include a first section that is substantially parallel to the shaft, and a second section that extends outward way from the shaft. The fingers may be flexible in an upwards and downwards direction into and away from the shaft. The exit roll is constructed to move media sheets out of the exit port and away from the image forming device.

DETAILED DESCRIPTION

Figure 1:
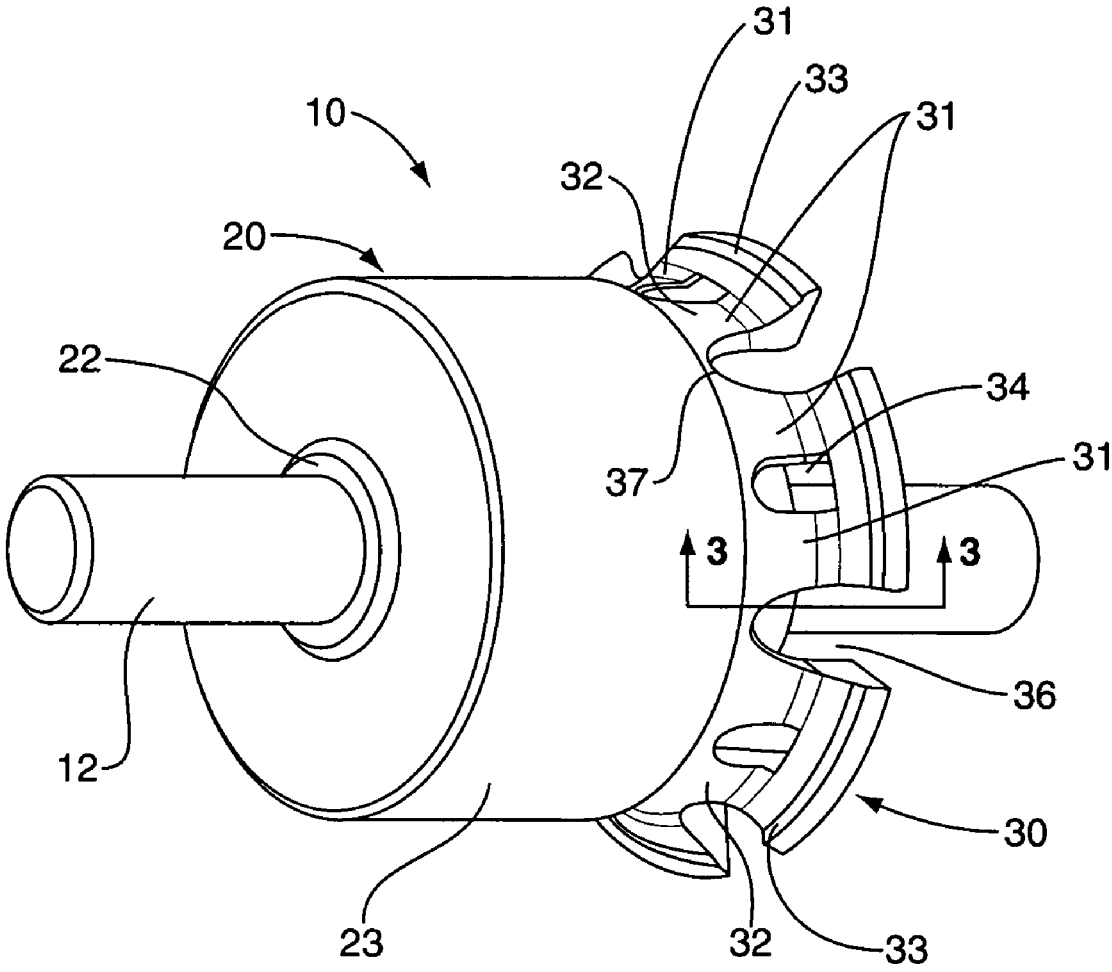
FIG. 1 is a front perspective view of an exit roll according to one embodiment of the present invention.

The exit roll according to one embodiment is illustrated in FIG. 1 and generally designated by element number 10. Exit roll 10 includes a body 20 and a kicker section 30. A shaft 12 extends through the body 20 and the kicker section 30. The kicker section 30 includes fingers 31 that are spaced along the periphery to contact the media sheets. The exit roll 10 is positioned at an exit port within the image forming device to expel the media sheets from a media path and into an output area.

Figure 2:
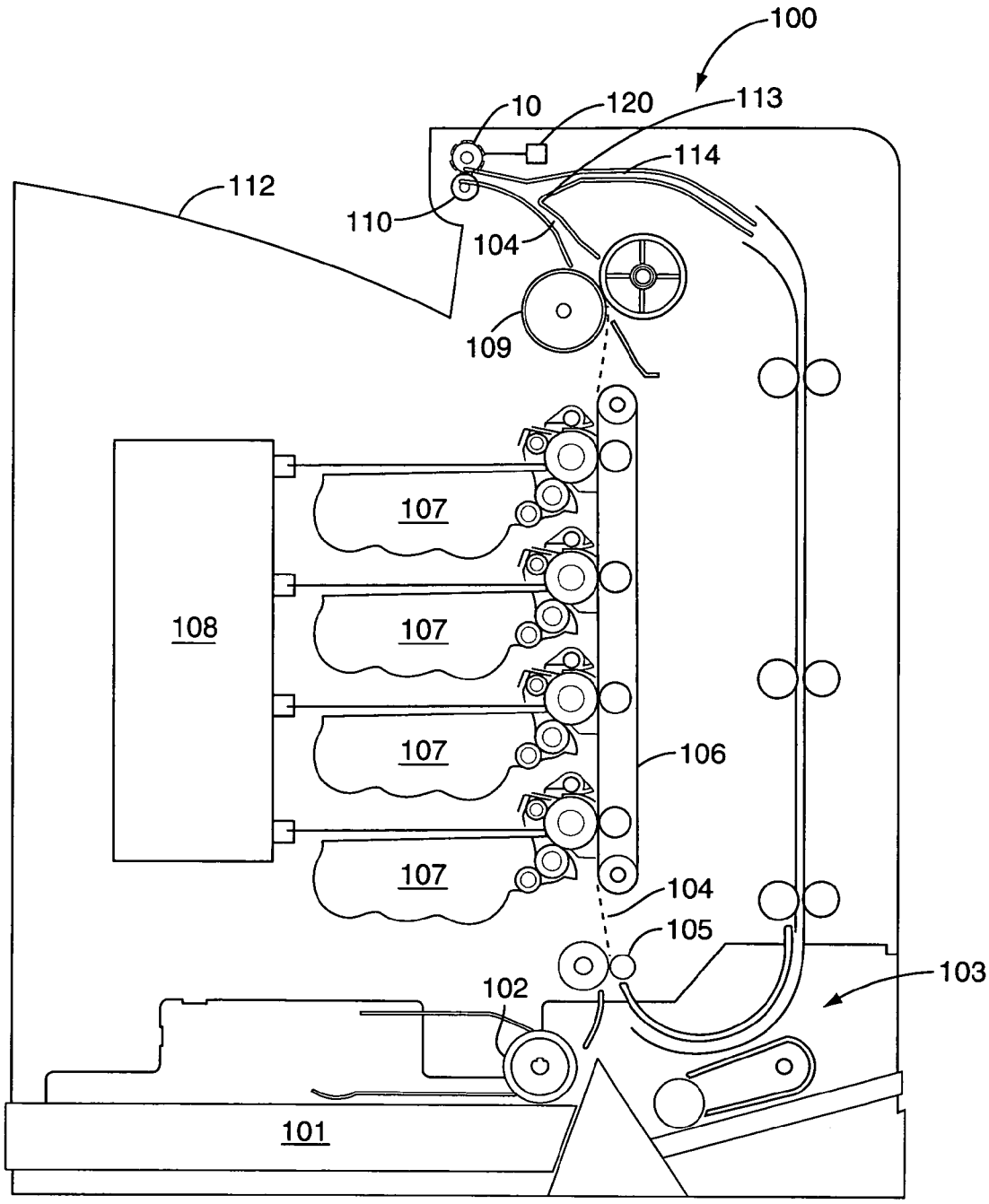
FIG. 2 is a schematic view of an image forming device according to one embodiment of the present invention.

To understand the context of the present application, FIG. 2 depicts a representative image forming device 100 having an exit roll 10. The image forming device 100 includes a media tray 101 with a pick mechanism 102, or a manual input 103, for introducing media sheets in the device 100. The media tray 101 is preferably removable for refilling, and located on a lower section of the device 100.

Media sheets are moved from the input and fed into a primary media path 104. One or more registration rollers 105 align the print media and precisely control its further movement along the media path 104. A media transport belt 106 forms a section of the media path 104 for moving the media sheets past a plurality of image forming units 107. Color printers typically include four image forming units 107 for printing with cyan, magenta, yellow, and black toner to produce a four-color image on the media sheet.

An imaging device 108 forms an electrical charge on a photoconductive member within the image forming units 107 as part of the image formation process. The media sheet with loose toner is then moved through a fuser 109 that adheres the toner to the media sheet. Exit roll 10 forming a nip with a nip roll 110 is positioned at an output area. The exit roll 10 rotates in a forward direction to expel the media sheet from the device 100 and out to an output tray 112. Alternatively, exit roll 10 may rotate in a forward direction for a limited time until a trailing edge of the media sheet passes an intersection point 113 along the media path 104. Exit roll 10 is then rotated in a reverse direction to drive the media sheet into a duplex path 114. The duplex path 114 directs the inverted media sheet back through the image formation process for forming an image on a second side of the media sheet.

Exit roll 10 comprises a body 20 positioned about a shaft 12 as illustrated in FIG. 1. Body 20 includes a central aperture 22 through which the shaft 12 extends. Body 20 further has a substantially constant width extending between the central aperture 22 and terminating at a relatively smooth exterior surface 23. A length of the body 20 extending along the shaft 12 may vary depending upon the application.

Figure 4:
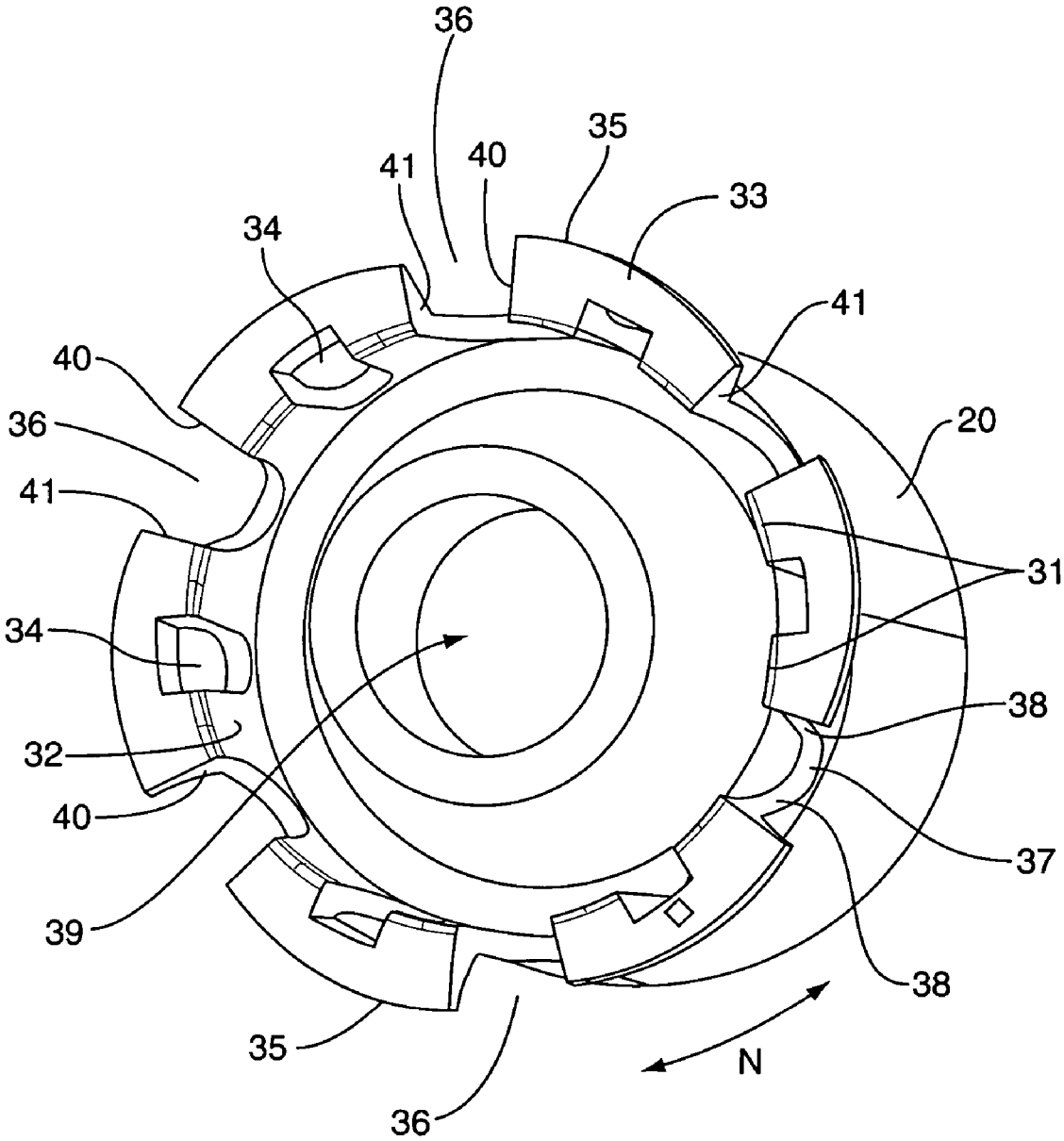
FIG. 4 is a rear perspective view of an exit roll according to one embodiment of the present invention.

The kicker section 30 is positioned adjacent to the body 20 as illustrated in FIGS. 1 and 4. A central aperture 39 extends through the exit section 30 to receive the shaft 12. Kicker section 30 includes a plurality of fingers 31 each having a base 32 and an extension 33. Base 32 extends substantially outward and away from the body 20. Extensions 33 are positioned at an end of and are angled relative to the base 32. In one embodiment, the kicker section 30 is constructed of PELLETHANE thermoplastic polyurethane elastomer available from Dow Corporation.

Figure 3:
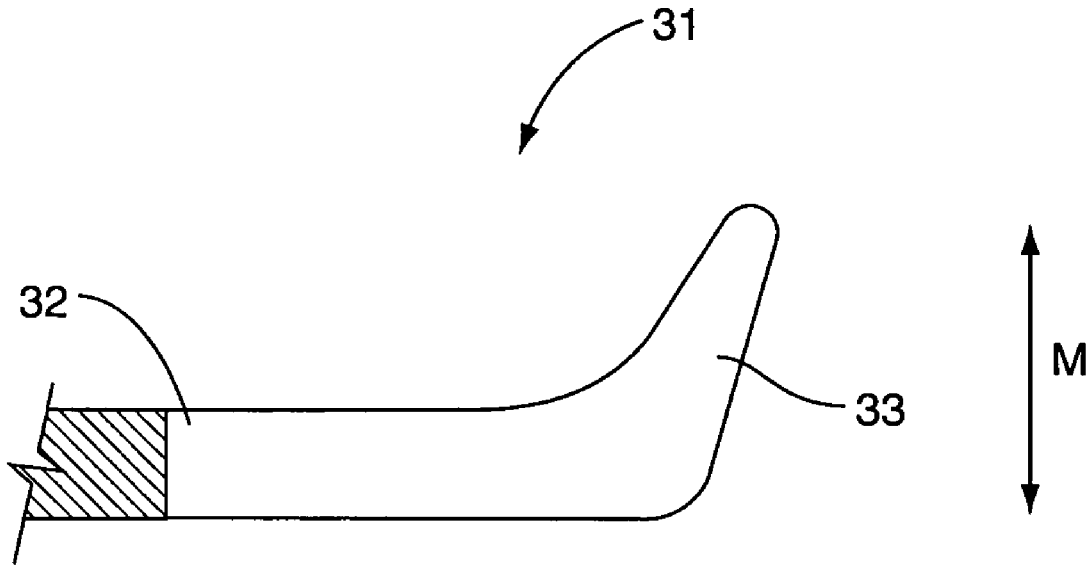
FIG. 3 is a partial cross-section view cut along line 3-3 of FIG. 1 of a finger according to one embodiment of the present invention.

FIG. 3 illustrates a cross-sectional view of a finger 31 having a base 32 and extension 33. A centerline of the extension 33 may be positioned at a variety of angles relative to a centerline of the base 32. In one specific embodiment, the angle is about 90 degrees. The extension 33 flexes inward and outward as it contacts roll 110 and/or the media sheet. This flexing movement is illustrated by arrow M and is in the direction towards and away from the central aperture 39. Flexing prevents large forces from building on the finger 31 which may cause excessive wear and lessen the lifespan.

As best illustrated in FIGS. 1 and 4, fingers 31 are positioned in pairs. Each pair includes two fingers 31 with a void 34 positioned between the fingers 31. The void 34 extends through the fingers 31 and is positioned at least within the base 32, and may extend into the extension 33. Void 34 allows the combined fingers 31 to more readily bend in the direction M as previously explained. Without the void 34, the fingers 31 would be less flexible causing greater wear. Combining the fingers 31 in pairs makes them stiffer in a direction N to move the media sheets out of the device 100 and towards the output tray 112.

A gap 36 is positioned between each pair of fingers 31 to increase flexibility and prevent excessive wear. The gap 36 extends through the entirety of the extension 33 and a majority of the base 32. In one embodiment, gaps 36 have a rounded bottom edge 37 formed within the base 32, and sidewall edges 38 that extend outward to the outer edge 35 of the extensions 33. The sidewall edges 38 may be parallel, or may diverge or converge again depending upon the application. Gaps 36 may have a variety of widths depending upon the application.

Figure 5:
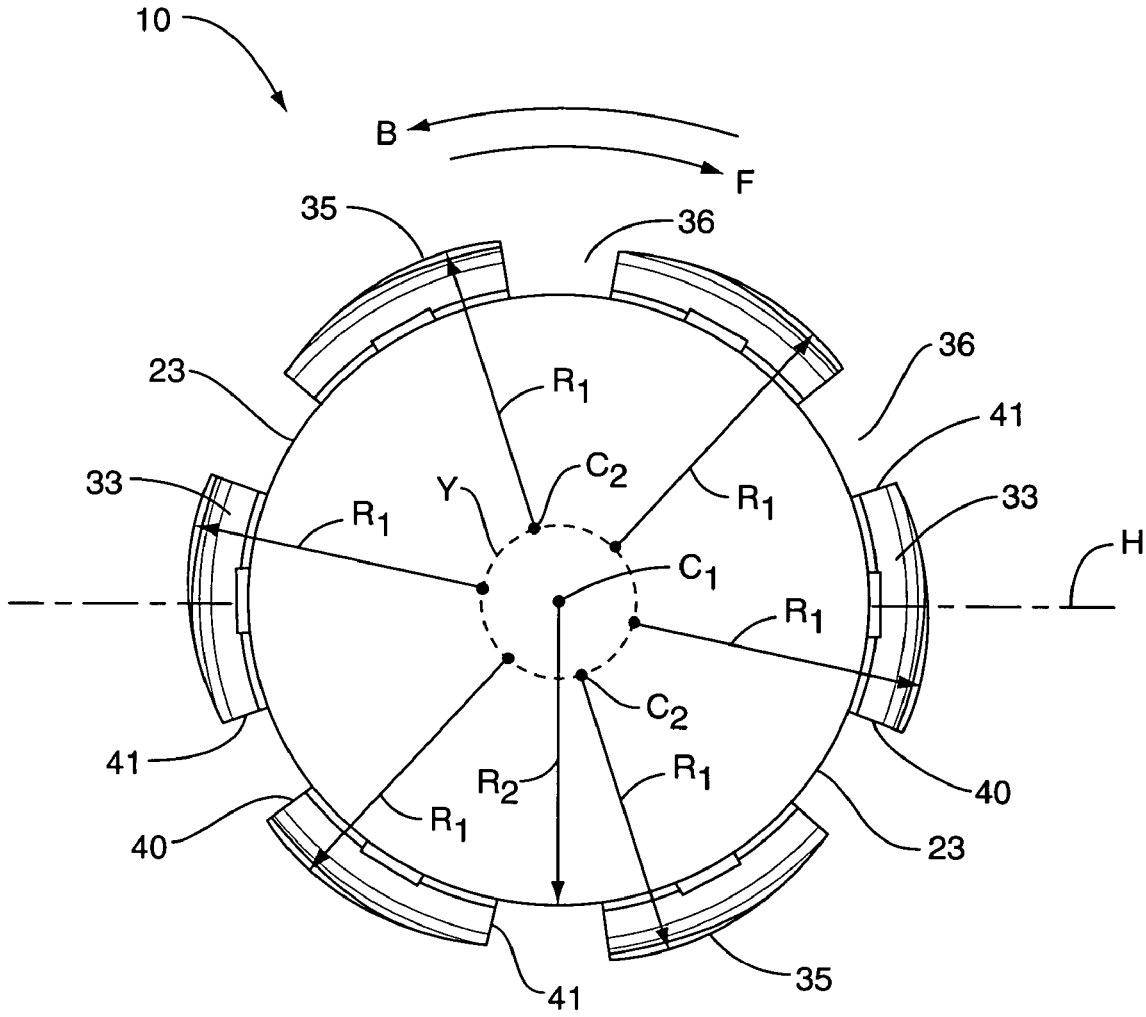
FIG. 5 is a schematic view of a rear of an exit roll according to one embodiment of the present invention.

As illustrated in FIG. 5, extensions 33 include a forward edge 40 and a reverse edge 41. When the exit roll 10 is rotating in a forward direction as illustrated by arrow F, the forward edge 40 contacts the media sheets. As previously stated, forward rotation of the exit roll 10 drives the sheet away from the media path 104 such as into the output tray 112. When the exit roll 10 rotates in a backwards direction as illustrated by arrow B, the reverse edge 41 contacts the media sheet to drive the sheet into the duplex path 114.

A radius R2 of the body 20 extends between a centerpoint C1 of the body and the exterior surface 23. Centerpoint C1 is further positioned along a horizontal axis H of the exit roll 10. Extensions 33 have a continuous outer edge 35 defined by a radius R1 extending from a centerpoint C2. Each extension 33 is positioned about a separate centerpoint C2. In the embodiment of FIG. 5, the six different extensions 33 are positioned about six different centerpoints C2 each positioned along a circumference Y about the centerpoint C1. Centerpoints C2 are offset from the centerpoint C1 thus forming the different heights for the forward 40 and reverse 41 edges. In one embodiment, radius R1 of the kicker section 30 formed at the extensions 33 is less than the radius R2 of the body 20.

Figure 6:
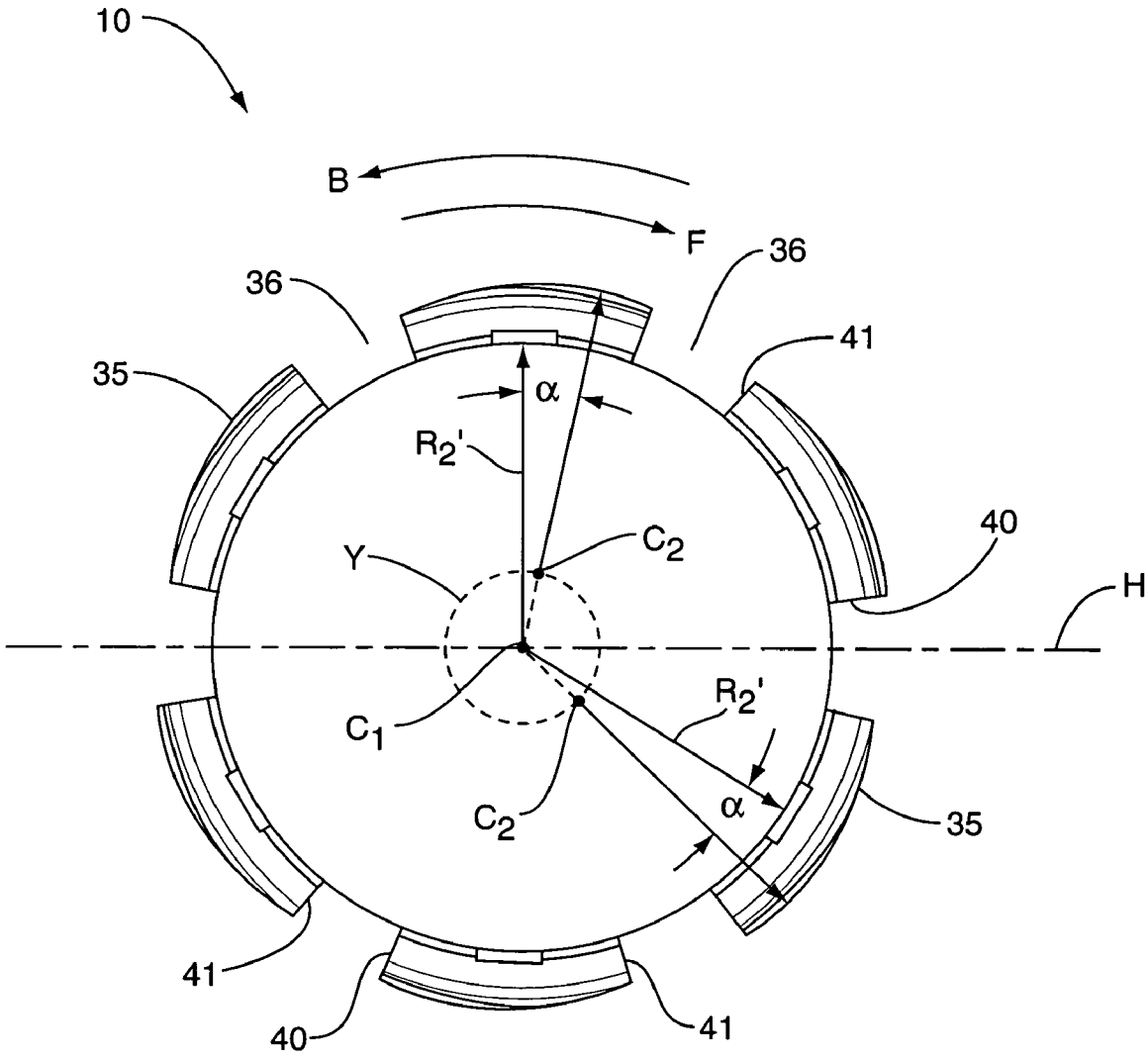
FIG. 6 is a schematic view of a rear of an exit roll according to one embodiment of the present invention.

As positioned in FIG. 6, a radius R2' is positioned that divides each extension 33 into two equal parts. Centerpoints C2 are positioned radially and angularly offset from the radius R2'. Angle $\alpha$ formed by R1 and R2' demonstrates the amount of angular offset. Angle $\alpha$ should not be equal to zero. Radial offset is the distance the centerpoint C2 is positioned away from centerpoint C1. These offsets result in each extension 33 having different heights for the leading 40 and trailing 41 edges. In the embodiments illustrated in FIGS. 5 and 6, the leading edge 40 has a greater height than the trailing edge 41.

In the embodiment illustrated in FIGS. 5 and 6, each of the centerpoints C2 has the same angular and radial offset. Therefore, the extensions 33 have the same size and shape. Other embodiments may feature two or more of the extensions having different sizes and shapes.

In one specific embodiment, the centerpoint C1 is positioned on the horizontal axis H and the centerpoints C2 each have the same angular and radial offset. The radius R2 of the body 20 is about 5.50 mm. Centerpoints C2 are each positioned on the circumference of a circle centered about the centerpoint C1. Each radius R1 is about 4.92 mm.

A thickness of the forward edge 40 is greater than that of the reverse edge 41. This is necessary because the forward edge 40 experiences twice the wear of the reverse edge 41. This is due in part to the greater number of sheets that are forwarded into the output tray 112 compared to the sheets that are duplexed into path 114. This is also due because the leading portion of duplexed sheets are moved in the forward direction F until the trailing edge of the sheet passes the intersection point 113. At this time, the roll 110 is moved in the reverse direction R and the sheet is driven into the duplex path 114.

The fingers 31 are rigid in the forward direction F and backward direction B. This causes the exit roll 10 to kick the media sheet away as it exits from the exit roll 10. Flexibility in these directions would dampen the effectiveness of the exit roll 10 to move the media sheet. The flexibility in the up and down directions indicated by arrow M in FIG. 3 does not adversely affect the rigidity in the forward and backward directions N, and does not adversely affect the ability of the exit roll 10 to move the media sheet.

Figure 7:
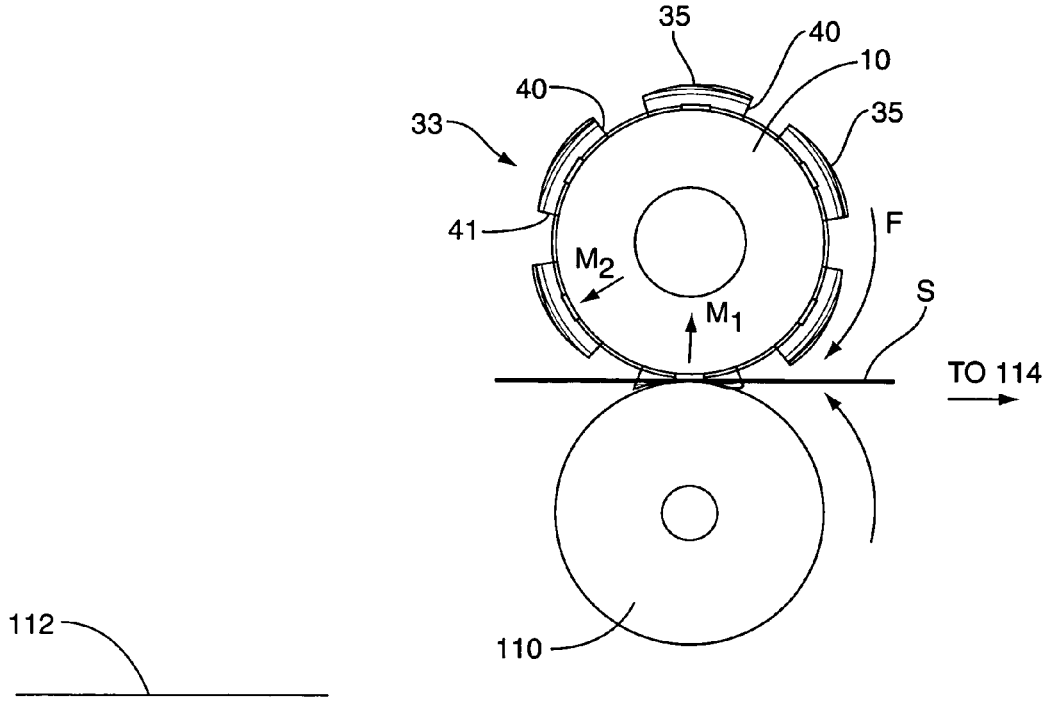
FIG. 7 is a schematic diagram illustrating a media sheet moving through a nip formed by the exit roll.
Figure 8:
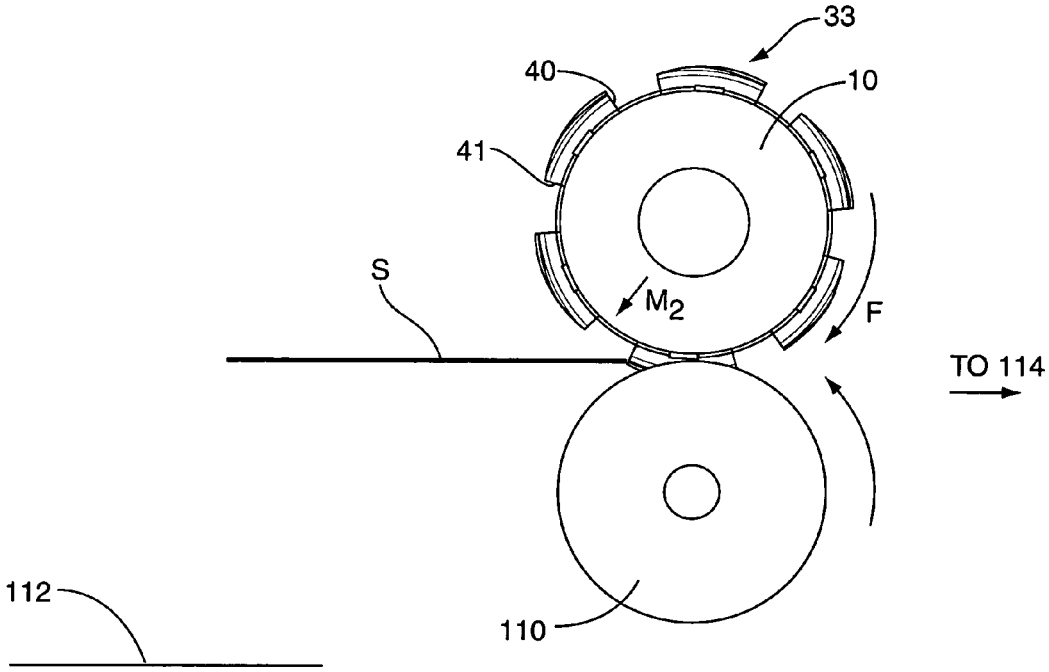
FIG. 8 is a schematic diagram illustrating a trailing edge of the media sheet exiting the nip formed by the exit roll.

In one embodiment, the exit roll 10 is positioned for the body 20 to contact roll 110. As a media sheet moves through this nip, the media sheet causes the fingers 31 to flex. FIGS. 7 and 8 illustrate the deformation as a media sheet S moves through the nip. Prior to contact with the sheet, the outer edge 35 of the extensions 33 extend radially outward beyond the radial extent of the exterior surface 23 of the body 20. When the fingers 31 contact the sheet, the fingers 31 flex inward as illustrated by arrow M1. While passing past the nip between the body 20 and roll 110, the outer edges 35 of the extensions 33 have substantially the same radial extent as the exterior surface 23.

As the exit roll 10 continues to rotate in direction F, the previously inwardly-flexed finger 31 flexes outward as illustrated by arrow M2. As the trailing edge of the media sheet S moves through the nip, the outward flexing M2 of the finger 31 pushes the media sheet S from the nip towards the output tray 112.

The greater height of the forward edge 40 causes the kicker section 30 to apply a greater force to the sheet as it moves towards the output tray 112. Likewise, the lower height of the reverse edge 41 causes the kicker section 30 to apply a lesser force to the sheet than the forward edge 40. This force may be adjusted by moving the location of the void 34. Moving the void 34 towards the forward edge 40 causes the kicker section 30 to apply a lesser force when moving the sheet towards the output tray 112 and a greater force when moving the sheet into the duplex path 114. Likewise, moving the void 34 towards the reverse edge 41 causes the kicker section 30 to apply a greater force to sheets moving towards the output tray 112 and less force towards the duplex path 114.

In one embodiment, the entirety or a portion of the kicker section 30 contacts the roll 110. This contact causes the fingers 31 to flex inward. After passing beyond the nip, the fingers 31 flex outward and move the sheet from the nip.

As illustrated in FIG. 2, a motor 120 operatively connected to the shaft 12 may drive the exit roll 10 in both the forward and reverse directions. Forward rotation causes the media sheets to be moved away from the media path 104. Reverse rotation causes the media sheet to be moved into the duplex path 114. In another embodiment, nip roll 110 is driven by the motor 120 and friction between roll 110 causes rotation of the exit roll 10.

The body 20 and kicker section 30 may be constructed as a single piece, or may be separate pieces. Further, a single exit roll 10 may be positioned along the media path 104 at the outlet port. Alternatively, two or more exit rolls 10 may be positioned along the width of the media path 104 and work in combination to move the media sheets.

The fingers 31 may be grouped together in pairs as illustrated in FIGS. 1 and 4. Fingers 31 may also be grouped in three of more, or may be isolated (i.e., not grouped). Fingers 31 may be evenly spaced about the periphery of the exit roll 10, or may be unevenly positioned at various points about the periphery.

In another embodiment, the exit roll 10 comprises only the kicker section 30 (i.e., no body 20). The roll 10 in this embodiment comprises a plurality of fingers 31 spaced about the periphery with each having a first section that extends substantially axially along the shaft 12, and a second section that extends substantially radially outwardly from the shaft 12. The fingers 31 are flexible into and away from the shaft in a similar manner as the embodiments previously discussed.

The present invention may be carried out in other specific ways than those herein set forth without departing from the scope and essential characteristics of the invention. In one embodiment, the rigidity of the nip roll 110 is greater than that of the kicker section 30. The present embodiments are, therefore, to be considered in all respects as illustrative and not restrictive, and all changes coming within the meaning and equivalency range of the appended claims are intended to be embraced therein.

What is claimed is:

1. A device to move a media sheet within an image forming device comprising:

a shaft;

a body mounted on the shaft and having an outer surface with a substantially constant radius;

a kicker section in contact with the body, the kicker section having a plurality of fingers each comprising a base that extends substantially axially away from the body, and an extension at a distal end of the base and extending substantially radially outward from the base;

each of the fingers being radially flexible between a first position that extends radially outward beyond the outer surface of the body, and a second position that is substantially at the same radial position away from the shaft as the outer surface of the body.

2. The device of claim 1, wherein the body and the kicker section are a single piece.

3. The device of claim 1, wherein the plurality of fingers are grouped in pairs with gaps separating each of the finger pairs.

4. The device of claim 3, further comprising a void positioned within each of the finger pairs, the void extends through at least a portion of the base.

5. The device of claim 4, wherein the void is positioned off-center within each of the finger pairs.

6. The device of claim 1, wherein the extension forms an angle of about 90 degrees with the base.

7. The device of claim 1, wherein the extension comprises first and second corners with the first corner having a greater height than the second corner.

8. The device of claim 1, wherein a radius of the kicker section formed at the extension is less than the body.

9. The device of claim 8, wherein a centerpoint of each of the plurality of fingers is positioned radially and angularly away from a body centerpoint.

10. A roll to move a media sheet along a media path within an image forming device comprising:

a plurality of fingers each having a first section extending substantially parallel to the media path, and a second section positioned along a peripheral edge of the first section and extending outward from the first section in a direction away from the media path;

each of the fingers having a continuous outer edge extending between a first edge and a second edge with the first edge having a greater height than the second edge.

11. The roll of claim 10, wherein the second section extends substantially perpendicularly outward from the first section.

12. The roll of claim 10, further comprising a body positioned proximate to the roll, the body having a substantially smooth exterior surface.

13. The roll of claim 12, wherein each of the fingers is flexible between a first position with a diameter of the fingers being greater than the body, and a second position with the diameter of the fingers being substantially equal to the body.

14. The roll of claim 10, wherein each of the fingers is grouped into pairs comprising a first finger and a second finger, a void is positioned between the first and second fingers.

15. The roll of claim 14, further comprising a gap positioned between a first finger pair and a second finger pair, the gap being larger than the void.

16. A device for moving a media sheet within an image forming device comprising:

a shaft;

a body mounted on the shaft and having an outer surface with a substantially constant radius;

a kicker section in contact with the body, the kicker section having a plurality of paired fingers spaced about the periphery, each of the paired fingers comprising two bases that extend substantially axially away from the body, and two extensions at a distal end of the bases and extending substantially radially outward from the bases;

each of the paired fingers being radially flexible between a first position that extends radially outward beyond the outer surface of the body, and a second position that is substantially at a same radial position away from the shaft as the outer surface of the body.

17. The device of claim 16, wherein a centerpoint of each finger is angularly and radially offset from a body centerpoint.

18. The device of claim 16, wherein each of the extensions comprise a leading edge and a reverse edge, the leading edge having a greater height than the reverse edge.

19. The device of claim 16, further comprising a void positioned within each of the paired fingers, the void extending through at least each of the two bases.

20. The device of claim 16, further comprising a gap position between each of the paired finger, the gap extending a distance inward from a peripheral edge beyond the two extensions and through a majority of the two bases.

* * * * *